US006293481B1

(12) United States Patent
Ragnarsson

(10) Patent No.: US 6,293,481 B1
(45) Date of Patent: Sep. 25, 2001

(54) ATTACHMENT ARRANGEMENT FACILITATING RAPID REPLACEMENT OF STRIKERS OF A WOOD COMMINUTING ROTOR

(76) Inventor: Anders T. Ragnarsson, 160 Brady Ave., Salem, NH (US) 03079

( * ) Notice: Subject to any disclaimer, the term of this patent is extended or adjusted under 35 U.S.C. 154(b) by 0 days.

(21) Appl. No.: 09/447,976

(22) Filed: Nov. 23, 1999

(51) Int. Cl.[7] ..... B02C 13/00
(52) U.S. Cl. ..... 241/197
(58) Field of Search ..... 241/197

(56) References Cited

U.S. PATENT DOCUMENTS 3,642,214 * 2/1972 Blackwell, Jr. ..... 241/197
3,935,774 * 2/1976 Craddy ..... 83/355
4,667,713 * 5/1987 Wright ..... 144/231
5,819,825 * 10/1998 Lyman et al. ..... 241/197
5,950,945 * 9/1999 Schaller ..... 241/189.1

* cited by examiner

*Primary Examiner*—Allen Ostrager
*Assistant Examiner*—William Hong
(74) *Attorney, Agent, or Firm*—Davis & Bujold, P.L.L.C.

(57) ABSTRACT

A comminuting striker and retainer for mounting to a striker mounting face of a comminuting rotor by bolts in which the striker is located by a projection on the retainer which can be disengaged from the striker by loosening the bolts without removing the bolts and retainer from the rotor, the striker having a slot which then allows the striker to be slid laterally from the bolts for removal from the rotor.

9 Claims, 6 Drawing Sheets

ATTACHMENT ARRANGEMENT FACILITATING RAPID REPLACEMENT OF STRIKERS OF A WOOD COMMINUTING ROTOR

The invention provides an improved striker for wood comminuting rotors which facilitates rapid replacement of the strikers without removal of associated parts and includes a combination of the striker and striker retainer.

BACKGROUND OF THE INVENTION

Prior art comminuting apparatus for reducing large diameter wood products and stumps to a desired size, have comprised a reduction chamber, with an impact rotor positioned concentrically therein, in combination with a housing, drive motor and infeed chute. The impact rotor is formed with a plurality of horizontally elongated impact strikers at its periphery. The rotor is positioned so that the elongated wood product or stump falling under the influence of gravity through the infeed chute is directed against the strikers, and repelled ahead of the rotor's rotational direction against an anvil formed along one side of the reduction chamber.

In prior art, wood comminuting apparatus, is often capable of comminuting trees or parts thereof up to 40 inches in diameter (see e.g. U.S. Pat. No. 5,165,611), strikers used for the comminution are bolted directly to mounting projections on the rotor which is rotated to produce the comminution. Maintenance to change strikers has required complete removal of the striker mounting bolts with a consequent potential loss of bolts and uneconomical use of maintenance time, especially in view of the substantial number of strikers on a rotor of such apparatus. Also the strikers of the prior art are only as wide as segments of the rotor with the result that wear on outer edges of the cutting edges of the strikers leaves gaps in cutting edges between segments leading to inefficient comminution and shortened striker life.

SUMMARY OF THE INVENTION

It is an object of the invention to improve maintenance time and ease of striker replacement in comminution apparatus without the potential for loss of components including bolts and associated nuts.

It is a further object of the invention to increase the life of strikers in such apparatus, as a result of (axial) edge wear of strikers.

According to the invention there is provided a comminuting striker for mounting on a rotor of a comminuting apparatus, comprising a body having opposed first and second ends, the first end of which defines a cutting edge and the second end of which defines a slot extending toward the first end, the slot being sized to provide passage for bolts used to attach the striker to a striker mounting face of the rotor and being shaped to allow the striker to be removed from the rotor without removing the bolts from the rotor.

According to the invention there is also provided a method facilitating replacement of a striker of a comminuting rotor in which the striker is clamped to a mounting face of the rotor by bolts, when tight, in engagement with the rotor and a retainer with the striker held in place by a projection on the retainer engaging a cooperating opening in the striker, comprising the step of: a) providing a slot in the striker to permit movement of the striker laterally of the bolts; b) loosening the bolts sufficiently, without the removal of the bolts and retainer from the rotor, to permit the projection to disengage from the opening; and c) sliding the slot of the striker laterally from the bolts to remove the striker from the rotor.

BRIEF DESCRIPTION OF THE DRAWINGS

The invention will now be described, by way of example, with reference to the accompanying drawings, in which.

DETAILED DESCRIPTION OF THE EMBODIMENTS

Figure 7:
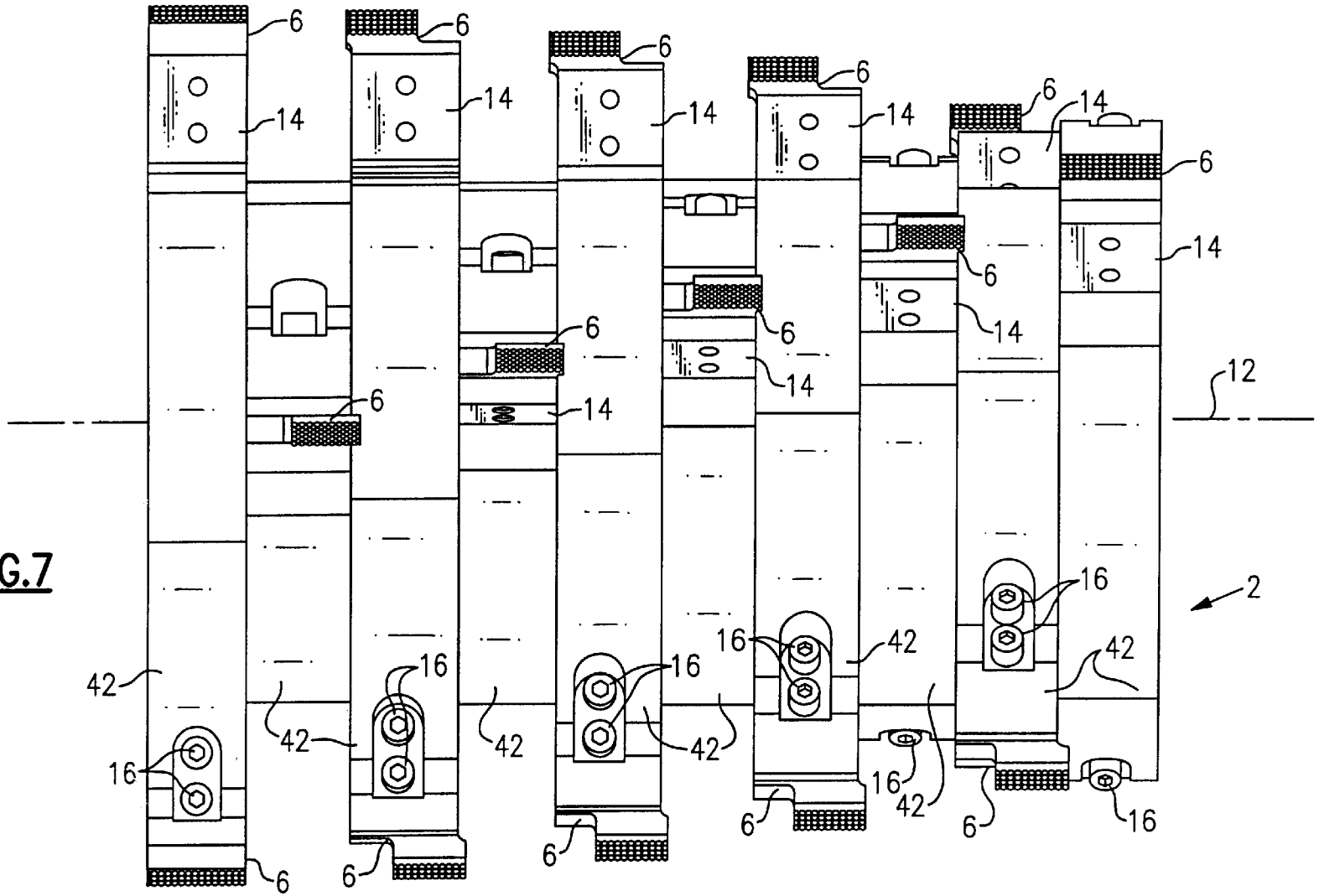
FIG. 7 is an elevation of a rotor with a plurality of strikers and retainers mounted thereto.

Referring first to the FIGS. 1–4, a rotor 2 of a wood comminutor defines a striker carrying face 4 for supporting a striker 6 against comminuting forces during comminution with the face 4 and cutting edge 8 of the striker 6 facing in the direction of rotor rotation 10 about rotor support axis 12 (FIG. 7).

The striker 6 is captively mounted to the face 4 by a retainer 14 which clamps the striker 6 against the face 4 by means of two bolts 16 extending through bores 18 in the rotor 2 and its face 4 to engage threaded holes 20 in the retainer 14.

Between the holes 20 on the face 22, facing the striker 6, of the retainer 14 is a centrally located rectangular projection 24 (other shapes will be apparent to those skilled in the art once the function of this projection is described below) which projects from face 22 toward the striker carrying face 4. The extent of this projection is less than the thickness T of the striker 6 and may be about ½ inch with the striker being about 1½ inches thick.

At the radially inner base area radially closest to the axis 12 is a flange 26 extending the width of the retainer 14 and projecting in the same direction as projection 24 preferably by about the same amount (e.g. ½ inch). The radially outmost surface 28 of this flange, facing the projection 24, comprises two surfaces 32 tapered downwardly toward the axis 12 to form a V-shape centered on the radially central axis 30 of the retainer relative to the axis 12. The angle of each surface 32 of the V-shape relative to the radial axis 30 may be, for example, about 84 to 85 degrees of arc.

The striker 6 has a slot 34, extending from it base 36 toward the cutting edge 8 to accommodate the bolts 16, shaped to allow the striker 6 to be removed from the rotor 2 and bolts 16 radially of the rotor axis 12, but for the restraint provided by the retainer 14. Within this slot 34, in opposed parallel sides thereof, are opposed rectangular recesses 38 sized and shaped to closely receive the projection 24 when the striker 6 is clamped to the striker carrying face 4, thereby to inhibit radially outward movement of the striker 6 from the rotor 2.

In addition, the lower, radially inner, relative to axis 12, surface of the striker 6 has a V-shape formed by surfaces 40 conforming to the surfaces 32 of the retainer 14. When engaged, these surfaces tend to close the slot 34 toward the bolts 16 upon application of radially inward forces being applied to the striker 6.

When a striker 6 needs replacement, the bolts are undone, but not removed, until the projection 24 may be moved out of the recesses 38 thereby allowing removal of the striker 6 from the rotor 2 without removing the retainer 14 or the bolts 16 from the rotor. This greatly speeds striker replacement and reduces potential loss of the retainer 14 and bolts 16 during maintenance.

Figure 5:
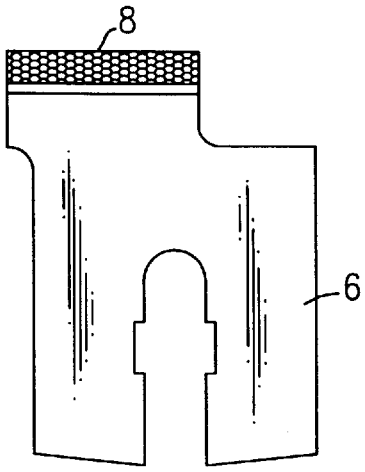
FIGS. 5 and 6 are variations of the striker of FIG. 1 with left and right offsets of their cutting edges respectively.
Figure 6:
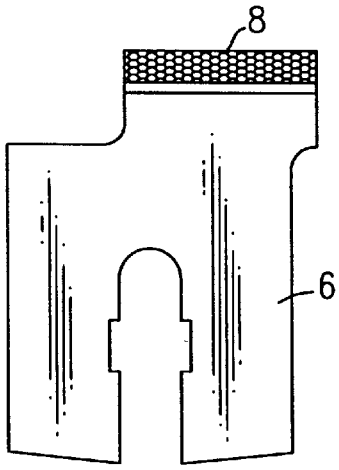

Turning now to FIGS. 5 and 6, the features of the strikers 6 described above apply except that the cutting edges 8 extend, respectively, beyond the left and right edges of the strikers 6 and are foreshortened, respectively, on the right and left of the strikers 6. The effect of these will be apparent from the following description of FIGS. 7 and 8.

Figure 8:
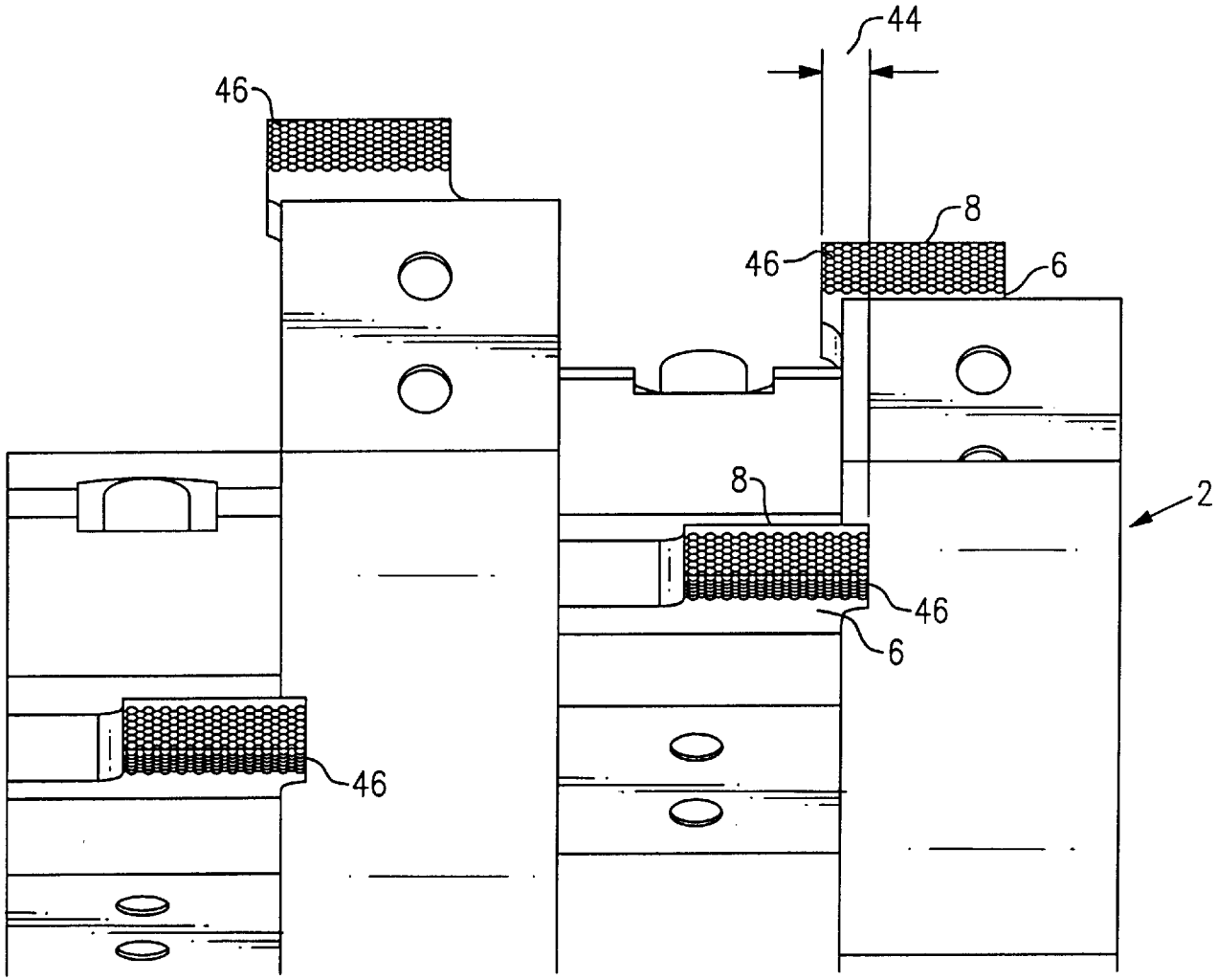
FIG. 8 is an enlarged view of a portion of FIG. 7 showing the overlap of strikers of FIGS. 5 and 6 at junctions between rotor segments.

FIGS. 7 and 8 illustrate a rotor 2 comprising ten axially serially connected segments 42 supported for rotation about axis 12. The strikers 6 of the inner segments are as described with reference to FIGS. 5 and 6 and alternate to provide cutting edge overlap 44 to extend striker life as outer cutting edge wear (in areas 46) is experienced.

Figure 1:
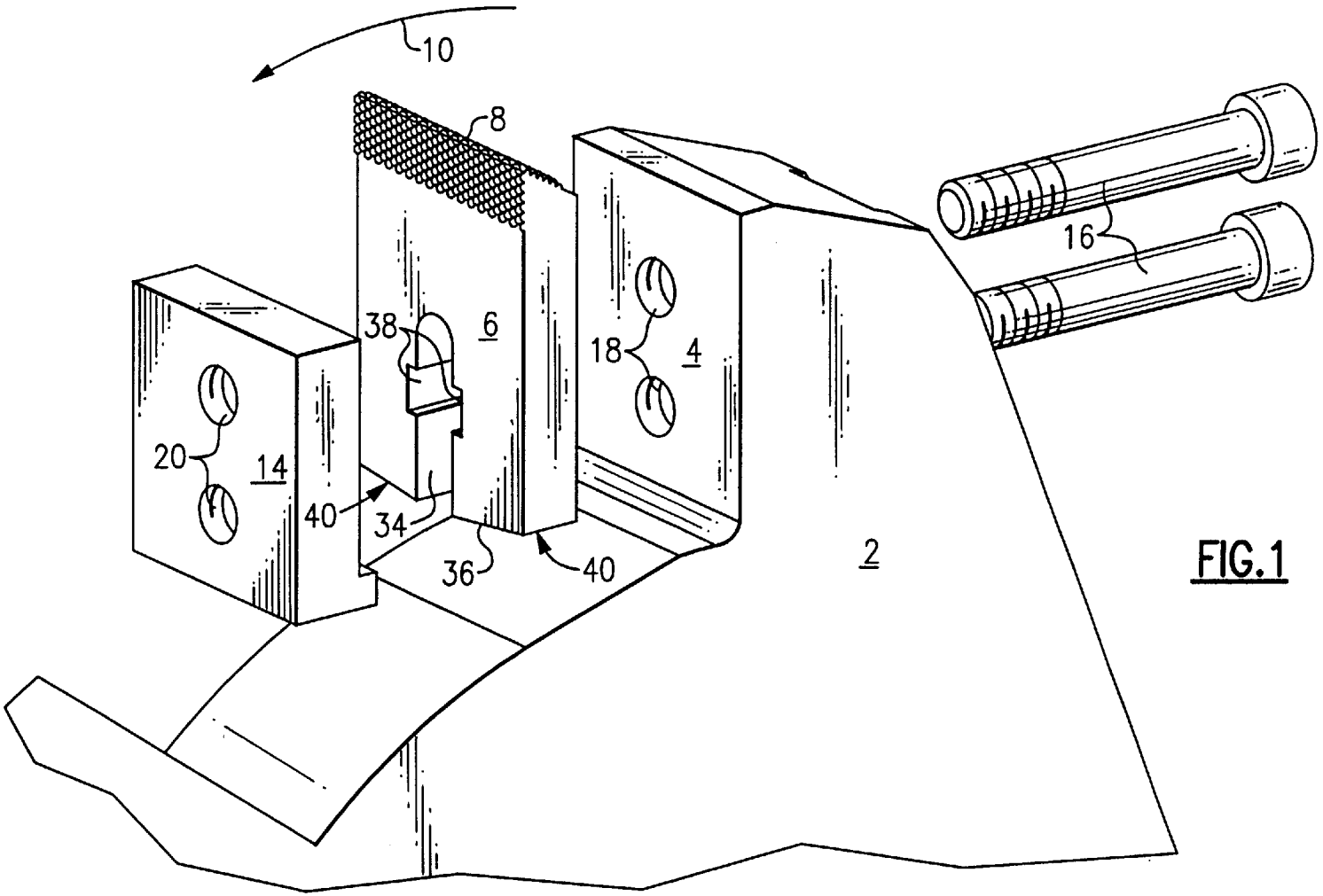
FIG. 1 is an exploded perspective view of a striker and retainer of the present invention adjacent a rotor of a wood comminutor and mounting bolts.
Figure 2A:
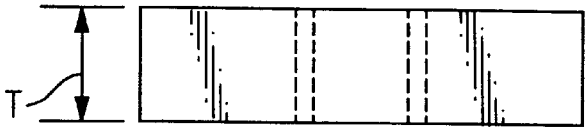
FIGS. 2A, 2B and 2C are, respectively, a plan, side elevation and face elevation of the striker of FIG. 1.
Figure 2B:
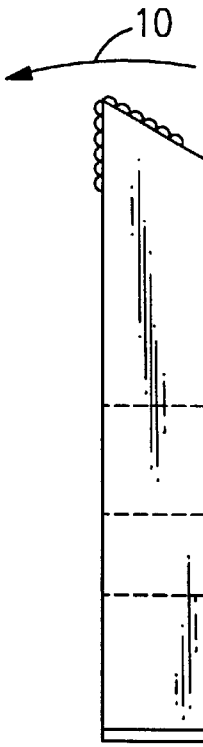
Figure 2C:
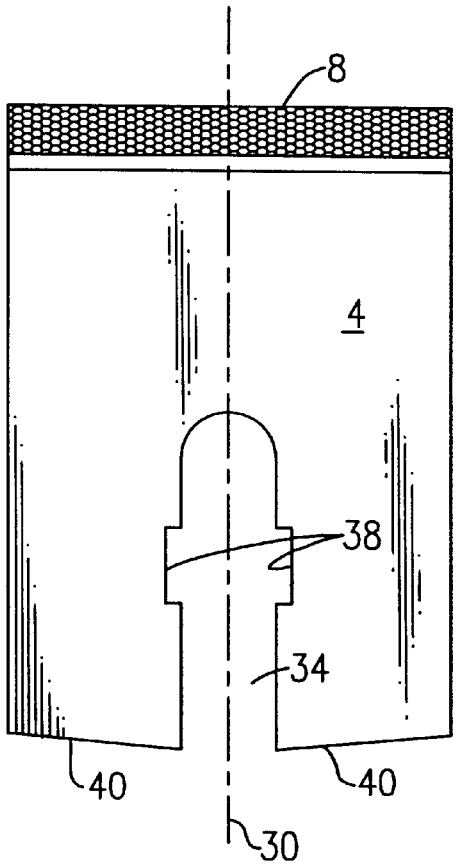
Figure 3A:
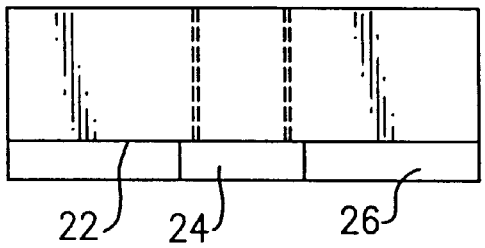
FIGS. 3A, 3B and 3C are, respectively, a plan, side elevation and face elevation of the retainer of claim 1.
Figure 3B:
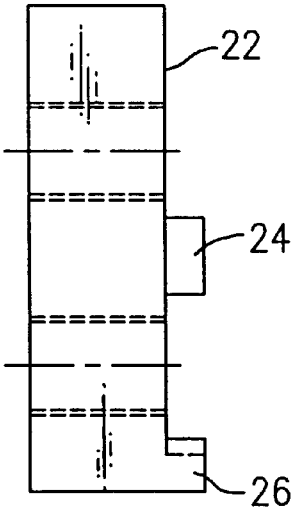
Figure 3C:
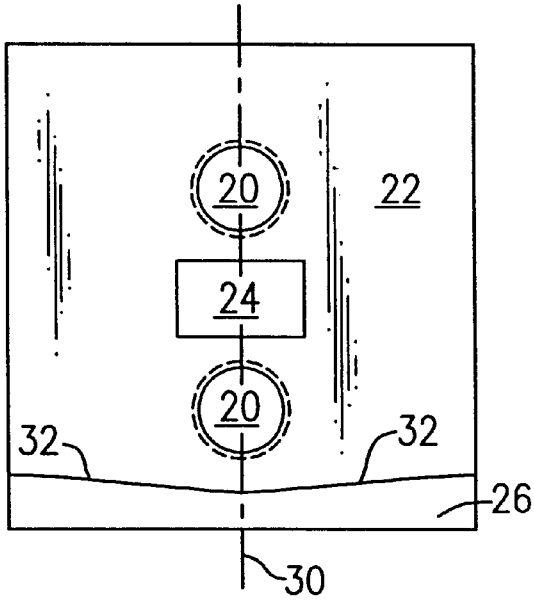
Figure 4:
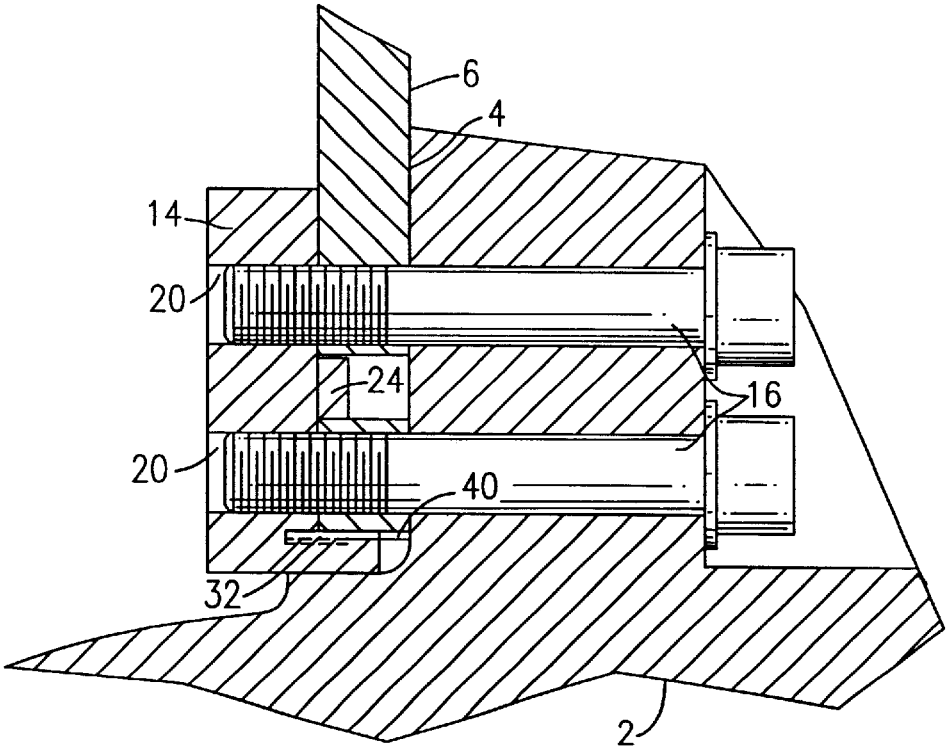
FIG. 4 is a sectional elevation of the striker, retainer, rotor and bolts of FIG. 1 assembled together.

The two outer segments 42 have strikers as illustrated in FIGS. 1 and 2 although other configurations will be apparent to those skilled in the art.

| Reference numerals |
|---|
| 2 rotor |
| 4 striker carrying face |
| 6 striker |
| 8 cutting edge |
| 10 direction of rotation |
| 12 axis of rotor |
| 14 retainer |
| 16 bolts |
| 18 bores |
| 20 holes |
| 22 face |
| 24 projection |
| 26 flange |
| 28 surface |
| 30 radial axis |
| 32 surfaces of V-shape |
| 35 slot |
| 36 base |
| 38 recesses |
| 40 surface |
| 42 segments |
| 44 overlap |
| 46 areas |

I claim:

1. A comminuting striker for mounting on a rotor of a comminuting apparatus, comprising a body having opposed first and second ends, the first end of which defines a cutting edge and the second end of which defines a slot extending toward the first end, the slot being sized to provide passage for bolts used to attach the striker to a striker mounting face of the rotor and being shaped to allow the striker to be removed from the rotor without removing the bolts from the rotor, wherein the slot is an elongate slot having parallel walls in which are formed opposite recesses able to accommodate a projection used to retain the striker on the rotor.

2. The striker of claim 1, wherein the second end defines sloping end faces extending outwardly from the slot and toward said first end.

3. The striker of claim 1 in combination with a retainer to clamp the striker against the mounting face by means of the bolts, the retainer defining the projection to cooperate with the opposed recesses to retain the striker on the rotor while allowing the striker to be removed from the rotor upon loosening of the bolts without the retainer and bolts being removed from the rotor.

4. The combination of claim 3, wherein the opposed recesses are rectangular and the projection has a rectangular transverse cross-section to be received closely within the opposed recesses.

5. The striker of claim 1, wherein the second end defines sloping end faces extending outwardly from the slot and toward said first end, in combination with a retainer to clamp the striker against the mounting face by means of the bolts, the retainer defining the projection to cooperate with the opposed recesses to retain the striker on the rotor while allowing the striker to be removed from the rotor upon loosening of the bolts without the retainer and bolts being removed from the rotor; and wherein the retainer has a flange defining slopping faces to cooperate with the sloping end faces of the striker, whereby when the striker is clamped to the striker mounting face by the retainer, force applied radially inwardly of the rotor will force the sloping faces and sloping end faces to tend to close the parallel faces of the slot together.

6. The combination of claim 4, wherein the retainer defines at least two threaded holes to receive a threaded end of the bolts and the projection is located between these threaded holes.

7. The striker of claim 1, wherein the cutting edge is offset laterally relative to the slot and projects laterally from a side of the striker, whereby strikers may be mounted on the rotor with alternating offsets to provide cutting overlap of the cutting edges during rotation of the rotor.

8. A method facilitating replacement of a striker of a comminuting rotor in which the striker is clamped to a mounting face of the rotor by bolts, when tight, in engagement with the rotor and a retainer with the striker held in place by a projection on the retainer engaging a cooperating opening in the striker, comprising the step of:

a) providing a slot in the striker to permit movement of the striker laterally of the bolts;

b) loosening the bolts sufficiently, without the removal of the bolts and retainer from the rotor, to permit the projection to disengage from the opening; and c) sliding the slot of the striker laterally from the bolts to remove the striker from the rotor.

9. The method of claim 8 comprising replacing the striker by reversing the steps a), b) and c).

* * * * *